US007690860B1

(12) United States Patent
Utz

(10) Patent No.: US 7,690,860 B1
(45) Date of Patent: Apr. 6, 2010

(54) TRAFFIC CONTROL DEVICE

(76) Inventor: Terry Utz, 18412 N. 55th Ave., Glendale, AZ (US) 85308

( * ) Notice: Subject to any disclaimer, the term of this patent is extended or adjusted under 35 U.S.C. 154(b) by 0 days.

(21) Appl. No.: 12/035,942

(22) Filed: Feb. 22, 2008

Related U.S. Application Data

(60) Provisional application No. 60/891,450, filed on Feb. 23, 2007.

(51) Int. Cl.
*E01F 9/00* (2006.01)
*E01F 9/013* (2006.01)

(52) U.S. Cl. ..... 404/9; 116/63 R

(58) Field of Classification Search ..... 404/6–16; 116/63 C–63 T
See application file for complete search history.

(56) References Cited

U.S. PATENT DOCUMENTS

| | | | | |
|---|---|---|---|---|
| 2,887,983 | A | 5/1959 | Budd | |
| 3,148,856 | A | 9/1964 | Orlando | |
| 4,343,567 | A | 8/1982 | Sarver et al. | |
| 4,430,638 | A | 2/1984 | Parker | |
| 4,489,306 | A | 12/1984 | Scolari | |
| 4,522,530 | A | 6/1985 | Arthur | |
| 4,574,726 | A | 3/1986 | Sullivan | |
| 4,633,215 | A | 12/1986 | Anders et al. | |
| 4,700,635 | A | 10/1987 | Eisen | |
| 4,737,049 | A * | 4/1988 | Callhan | 359/551 |
| 4,875,028 | A | 10/1989 | Chou | |
| 4,876,812 | A | 10/1989 | Haralson | |
| 4,919,563 | A * | 4/1990 | Stice | 404/6 |
| 5,156,274 | A * | 10/1992 | Williams, Jr. et al. | 206/573 |
| 5,294,924 | A | 3/1994 | Dydzyk | |
| 5,323,728 | A | 6/1994 | Hjelm | |
| 5,470,171 | A * | 11/1995 | Tseng | 404/13 |
| 5,551,370 | A | 9/1996 | Hwang | |
| 6,119,621 | A | 9/2000 | Johnson | |
| 6,182,336 | B1 * | 2/2001 | Bauer | 24/303 |
| 6,599,001 | B2 | 7/2003 | Johnson | |
| 6,945,731 | B1 | 9/2005 | Vait | |
| 7,047,680 | B2 | 5/2006 | Myles | |
| 7,051,466 | B1 | 5/2006 | Barnes | |
| 7,158,020 | B2 | 1/2007 | Grady, Jr. | |
| 2003/0123930 | A1 * | 7/2003 | Jacobs et al. | 404/12 |

* cited by examiner

*Primary Examiner*—Raymond W Addie
(74) *Attorney, Agent, or Firm*—Schmeiser, Olsen & Watts LLP

(57) ABSTRACT

A traffic control device includes a base having a post aperture, a post adjustably and removably coupled to the base through the post aperture and a pavement marker. The pavement marker is affixed to a surface. The base may include a recess for receiving the pavement marker, such that a bottom side of the base rests on the surface with the pavement marker retained within the base. The post aperture extends from a top surface of the base to the recess of the base. The post includes one of a magnet and a metal plate coupled to an end of the post. The pavement marker includes one of a magnet and a metal plate, wherein the pavement marker comprises a magnet if the post comprises a metal plate and the pavement marker comprises a metal plate if the post comprises a magnet.

11 Claims, 8 Drawing Sheets

TRAFFIC CONTROL DEVICE

CROSS REFERENCE TO RELATED APPLICATION

This claims priority to U.S. Provisional Patent Application entitled "TRAFFIC CONTROL DEVICE," Ser. No. 60/891,450, filed Feb. 23, 2007, the disclosures of which are hereby incorporated entirely herein by reference.

BACKGROUND OF THE INVENTION

1. Technical Field

This invention relates generally to a portable, moveable traffic sign or marker having a magnetic base for use in traffic control and the method of using the sign or marker.

2. State of the Art

Pedestrian safety is a big concern, especially in school zones where small children may be present. In one method for improving pedestrian safety, in-street pedestrian crossing signs are used to alert drivers of potential pedestrians. The use of in-street pedestrian crossing or school zone signs has been shown to increase driver yielding compliance. Additionally, posts or other markers positioned along the edges of a crosswalk increase driver awareness of the location of the crosswalk.

While these in-street signs and posts are a low-cost safety improvement, there are problems and disadvantages associated with them. In some instances, such as during snow removal or other maintenance, it is desirable for the signs and posts to be easily portable to facilitate set up and removal. For example, in a school crossing zone, such signs and posts may be set up and removed at least twice per day during school commute times. In order for the signs and posts to be easily portable, the sign, the post and the base to which the sign or post is attached may be relatively lightweight. One disadvantage of this is that the lightweight sign or post may move from the desired location due to weather or impact from passing cars.

In order to ensure that the signs and posts remain in the desired location, the base may either be relatively heavy or fixedly attached to the roadway. One disadvantage of a heavy base is that it is not easily portable. One disadvantage of a fixedly attached base is that it may impede the flow of traffic.

Accordingly, there is a need in the field of traffic control for a traffic control device that is easily portable and is also attached to a surface in a substantially fixed position.

DISCLOSURE OF THE INVENTION

The present invention relates to a traffic control device that includes a base, a post, and a pavement marker. The post is attached to one side of the base and the base is magnetically coupled to the pavement marker. The post may include a reflective coating or high intensity retro reflective sheeting applied thereto. Alternatively, signs or other traffic control measures may be attached to the post. It will be understood that a pavement marker may be applied to various types of surfaces, such as but not limited to pavement, concrete, brick, or any other type of surface. Further, the pavement marker may be any type of marker, such as a raised marker, a flat marker or other type of marker used to direct traffic or as warning devices in traffic applications.

An aspect of the present invention may include a traffic control device comprising a base, a post, and a pavement marker. The pavement marker may be affixed to a surface. The base may include a recess for receiving the pavement marker, such that a bottom side of the base rests on the surface with the pavement marker retained within the base. The base may also include a post aperture extending from a top side to the recess, the post aperture configured to removably couple the post to the base. The post may also comprise one of a magnet and a metal plate. The pavement marker may comprise one of a magnet and a metal plate, wherein the pavement marker comprises a magnet if the post comprises a metal plate and the pavement marker comprises a metal plate if the post comprises a magnet.

According to particular embodiments of the present invention, the base may further include a release button. The release button may be disposed in a through hole in a sidewall of the base. The release button may protrude from the outside wall of the base. The end portion of the release button that is disposed within the base may have a tapered or pointed end.

The present invention additionally relates to a method of using the traffic control device. The method includes the steps of attaching a pavement marker to a surface and positioning a base of traffic control device over the pavement marker, and magnetically attracting the base of the traffic control device to the pavement marker. The method may further include removing the base from the surface by detaching the base from the metal plate and re-locating the base to a desired storage location. Detaching the base from the metal plate may be accomplished by tipping, tilting or lifting the base to break the magnetic bond between the metal plate and the magnet. Detaching the base from the metal plate may further be accomplished by pressing the release button to break the magnetic bond between the metal plate and the magnet.

In a specific embodiment, the present invention relates to a method of using the traffic control device in a school crossing zone including the steps of attaching a plurality of pavement markers to the surface in desired positions in the school crossing zone and positioning bases of a plurality of traffic control devices over the plurality pavement markers and magnetically attracting the plurality of traffic control devices to the plurality of pavement markers. The desired positions may include the edges of the crosswalk and spaced intervals along the centerline for several feet approaching the crosswalk. The bases may each have at least a post attached thereto. The plurality of bases may each have a sign additionally attached thereto. Specifically, the bases positioned along the edges of the crosswalk may have a post attached thereto in order to increase driver awareness of the location of the crosswalk, especially in low light or inclement weather. The bases positioned along the centerline approaching the crosswalk may have posts attached thereto and signs attached to the posts. The method may further include removing the bases from the surface by detaching the base from the metal plate and re-locating the base to a desired storage location. Detaching the base from the metal plate may be accomplished by tipping, tilting or lifting the base to break the magnetic bond between the metal plate and the magnet. Detaching the base from the metal plate may further be accomplished by pressing the release button to break the magnetic bond between the metal plate and the magnet. The pavement markers may be reflective to provide additional awareness to drivers of the crosswalk, particularly after the traffic control device have been detached and re-located.

One advantage of the present invention is that the base and post are easily portable. Another advantage is that the traffic control device remains in a substantially fixed position due to the fixed position of the pavement marker and the strength of the magnetic bond between the base and the pavement marker. Yet another advantage is that the quick and easy removal of the traffic control device means reduced exposure and increased safety for workers. Still another advantage is that the removability of the base reduces damage to vehicles and vehicle passengers in the case of a collision with the traffic control device.

The foregoing and other features and advantages of the present invention will be apparent from the following more detailed description of the particular embodiments of the invention, as illustrated in the accompanying drawings.

DETAILED DESCRIPTION OF EMBODIMENTS OF THE INVENTION

As discussed above, embodiments of the present invention relate to a traffic control device that includes a base, a post, and a pavement marker. The post is attached to one side of the base and the base is magnetically coupled to the pavement marker. The post may include a reflective coating or high intensity retro reflective sheeting applied thereto. Alternatively, signs or other traffic control measures may be attached to the post. Thus, the post and base are easily attached to and repeatably removed from the particular location on the surface.

Figure 1:
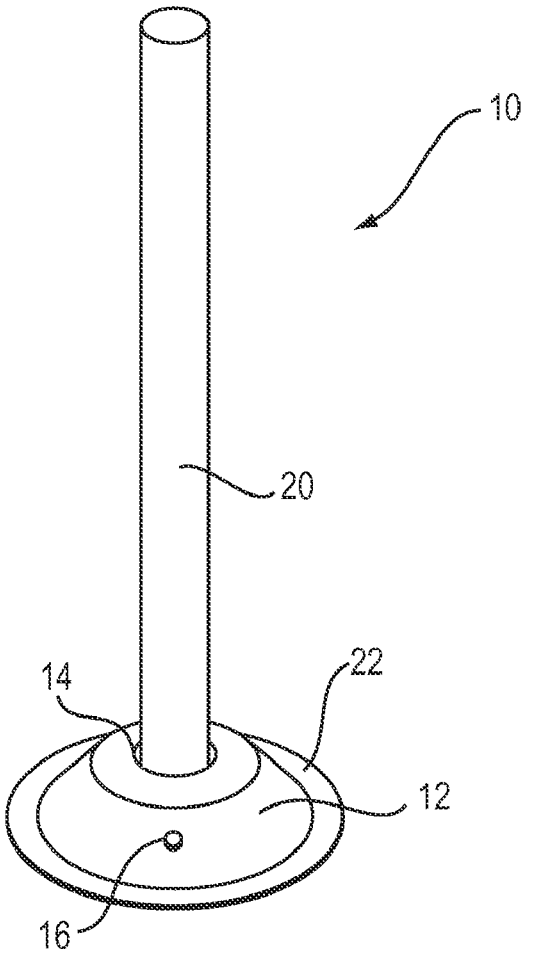
FIG. 1 is a perspective view of the traffic control device.
Figure 2:
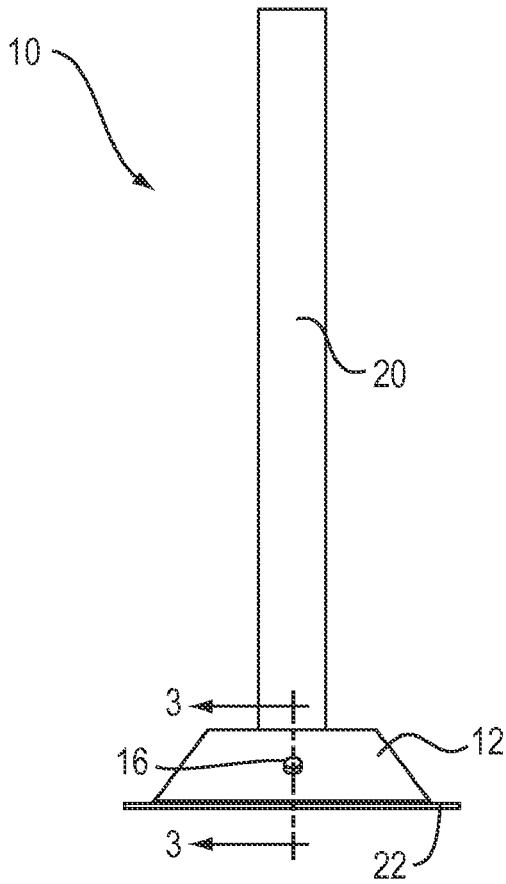
FIG. 2 is a side view of the traffic control device.

Referring to the drawings, FIGS. 1 and 2 depict a traffic control device 10 that includes a post 20 attached to a base 12. The post 20 is attached to the base 12 by inserting the bottom portion of the post into an opening 14 in the base. Any convenient and effective attachment mechanism may be used to attach the post 20 to the base 12. For example, the post 20 may be removably attached, such as by friction fitting, where the diameter of the opening 14 is only slightly larger that the outside diameter of the bottom portion of the post 20. Alternatively, the post 20 may be attached by adhesive, locking pins or other effective attachment means.

Figure 3:
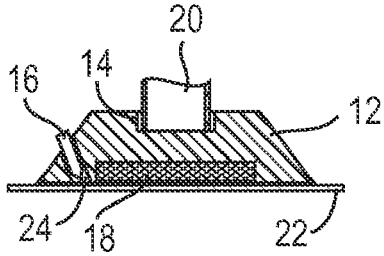
FIG. 3 is a cross-sectional view of the traffic control device along sectional line 3-3 in FIG. 2.

Referring to FIG. 3, the base 12 may include a magnet 18 adjacent to a bottom surface of the base 12. The magnet 18 is embedded in the base 12 such that the bottom surface of the magnet 18 is flush with the bottom surface of the base 12.

The traffic control device 10 further includes a metal plate 22. The base 12 is attached to the metal plate 22 by magnetic attraction between the metal plate 22 and the magnet 18 within the base 12.

In one aspect, the traffic control device 10 may also include a release button 16 for aiding in separating the base 12 from the metal plate 22. The release button 16 protrudes from a sidewall of the base 12 and is disposed in an opening 24 that extends through the base 12. The end portion of the release button 16 that is disposed in the opening 24 may have a tapered or pointed end, as shown in FIG. 3. Pressing the release button 16 applies pressure to the metal plate 22 at the contact point between the tapered or pointed end of the release button 16 and the metal plate 22. The pressure applied is sufficient to force separation of the magnet 18 from the metal plate 22, thus weakening the magnetic bond and allowing for easier removal of the base 12 from the plate 22.

Figure 4:
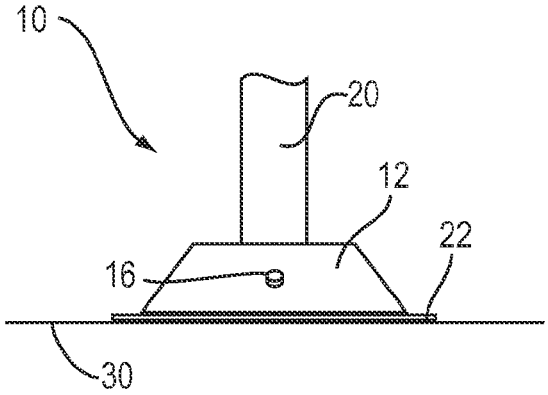
FIG. 4 is an enlarged view of the bottom portion of the traffic control device positioned on a surface.

In a method of using the device 10, the metal plate 22 is fixed to the surface 30 in a particular location, as shown in FIG. 4. Then, the base 12 and post 20 can be easily affixed to and removed from the surface 30 in the particular location by positioning the base 12 on the metal plate 22. The metal plate 22 may be attached to the surface 30 using adhesive, bolts, or any other effective attachment means.

The width or circumference of the metal plate 22 may be greater than the width or circumference of the magnet 18, as shown in FIGS. 1-4. The thickness of the metal plate 22 is sufficient to provide a strong magnetic bond between the plate 22 and the magnet 18, yet is thin enough so that it does not impede the surface. In some embodiments, it may be desirable for the strength of the magnetic bond to be such that the magnet 18 and the metal plate 22 do not need to be in direct contact. For example, a plastic or other protective layer may be disposed over the metal plate 22. The strength of the magnetic bond is sufficient to maintain the traffic control device 10 in a substantially fixed position even though there may be intervening layers between the magnet 18 and the metal plate 22.

Figure 8:
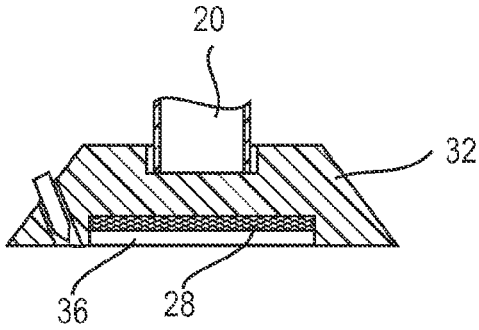
FIG. 8 is a cross-sectional view of another embodiment of the traffic control device.
Figure 9:
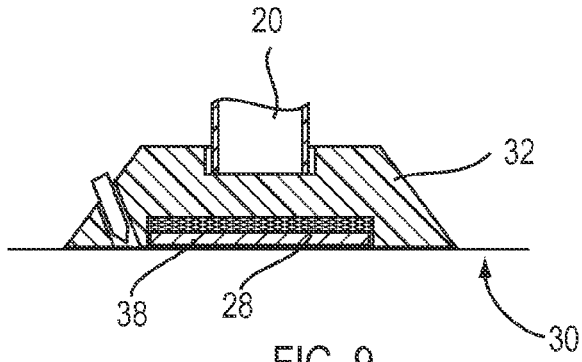
FIG. 9 is a cross-sectional view of an additional embodiment of the traffic control device positioned on a surface.

In an alternate embodiment shown in FIGS. 8-9, the magnet 28 may be embedded in the base 32 such that the bottom of the magnet 28 and the bottom of the base 32 are not flush and there is an indentation 36 in the bottom surface of the base. The width or circumference of the metal plate 38 is substantially the same as the width or circumference of the magnet 28 so that the metal plate 38 fits into the indentation 36 in the bottom of the base. The metal plate 38 is fixedly attached to the surface 30 in a desired location.

Figure 5:
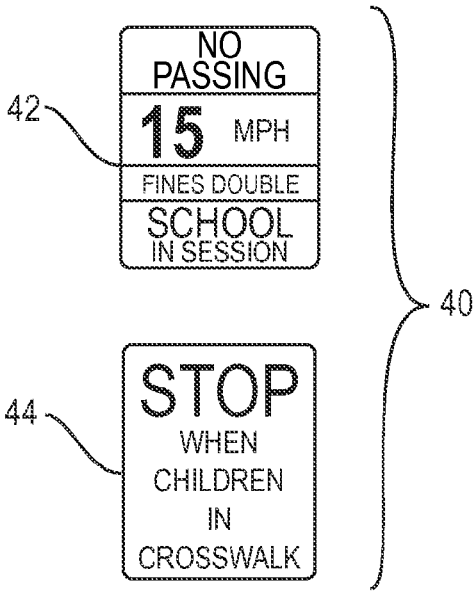
FIG. 5 is a front view of various signs to be used in conjunction with the traffic control device.

Examples of signs 40 that may be attached to the post 20 are shown in FIG. 5. Signs 42 and 44 are particularly useful in school crossing zones. Alternatively, the post 20 may include a reflective coating or high intensity retro reflective sheeting applied thereto.

Figure 6:
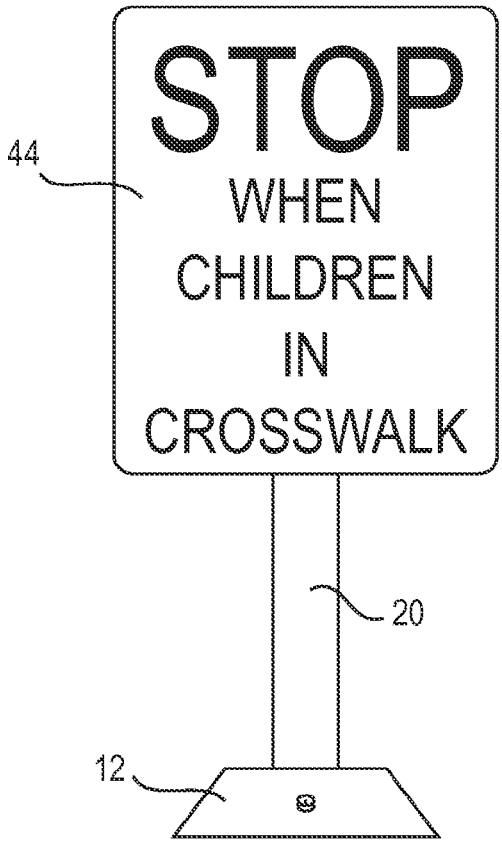
FIG. 6 is a front view of the traffic control device with a sign attached.

FIG. 6 shows an example of the traffic control device with a sign 44 attached to the post 20. The sign 44 is used as an example and it should be understood that any other desired sign, including but not limited to those from FIG. 5, may be attached to the post 20. Additionally, attachments to the post 20 are not limited to signs. Any desired symbol, flag or other traffic control measure may be attached to the post 20. The attachment means include adhesive, bolts, straps or any other effective means for attaching signs, symbols, flags, etc to the post 20.

Figure 7:
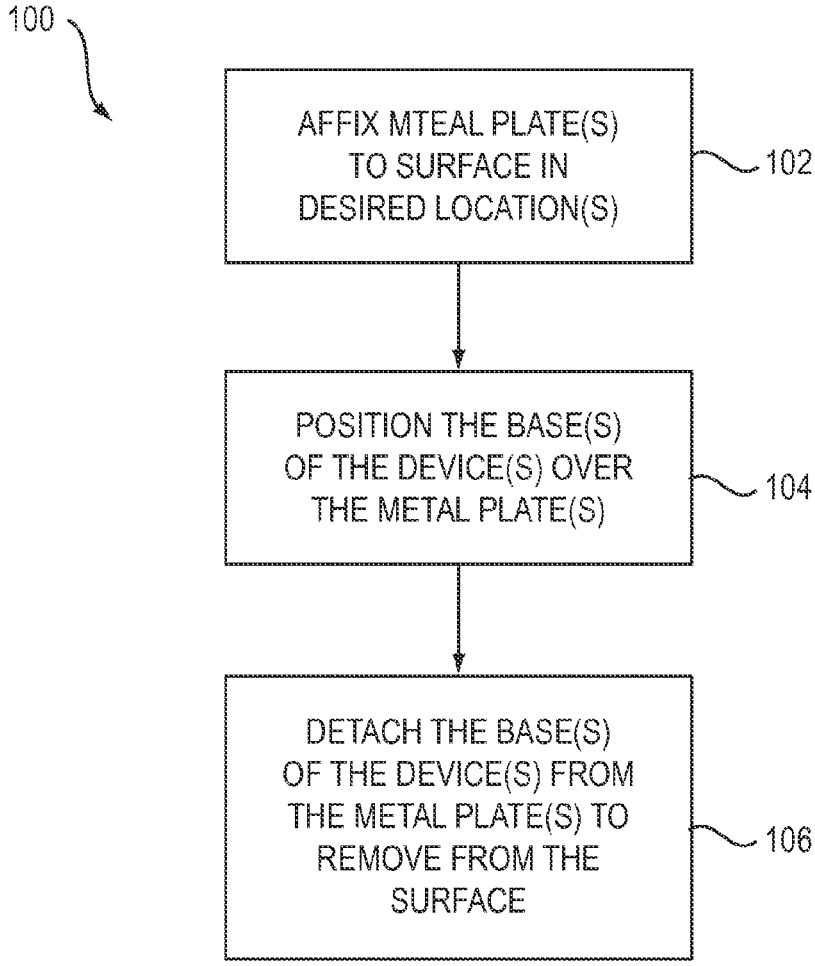
FIG. 7 is a flow chart of the method of using the traffic control device.

In another aspect, a method 100 of using the device 10 is depicted in FIG. 7. In a first step 102, at least one metal plate 22 is affixed to the surface 30 in a desired location. In a second step 104, a base 12 with an attached post 20 is positioned over the metal plate 22 so that the magnet 18 embedded in the base 12 may contact the plate 22. Thus, the base 12 and post 20 are removably attached to the desired position on the surface. In step 106, when the traffic control device 10 is no longer needed, the base 12 and post 20 are removed from the surface 30 by detaching the base 12 from the plate 22 and re-locating the base 12 to a desired storage location. Detaching the base 12 from the metal plate 22 may be accomplished by tipping, tilting or lifting the base 12 to break the magnetic bond between the metal plate 22 and the magnet 18. In another embodiment, detaching the base 12 from the metal plate 22 may further be accomplished by pressing the release button 16 to break the magnetic bond between the metal plate 22 and the magnet 18.

The traffic control device 10 described above is particularly useful in traffic control situations where it is desirable to repeatably be able to quickly and easily set up and take down several of the devices. In a specific example, in school crossing zones, signs 42 and 44 shown in FIG. 5 may need to be set up and removed at least twice per day during school commute times. Using the traffic control device 10 described above, the set up and removal of the signs and posts is quick and easy and the signs and posts are maintained in a substantially fixed location on the surface. Several posts may be positioned along the edges of a crosswalk in a school crossing zone in alignment with the center line, lane lines and the edge lines of the traffic lane in order to increase driver awareness of the location of the crosswalk, especially in low light or inclement weather conditions. Additionally, signs 42 and 44 may be positioned along the center line at intervals for several feet approaching the crosswalk from each direction to notify a driver of the approaching school crossing zone and reduced speed limit.

Figure 10:
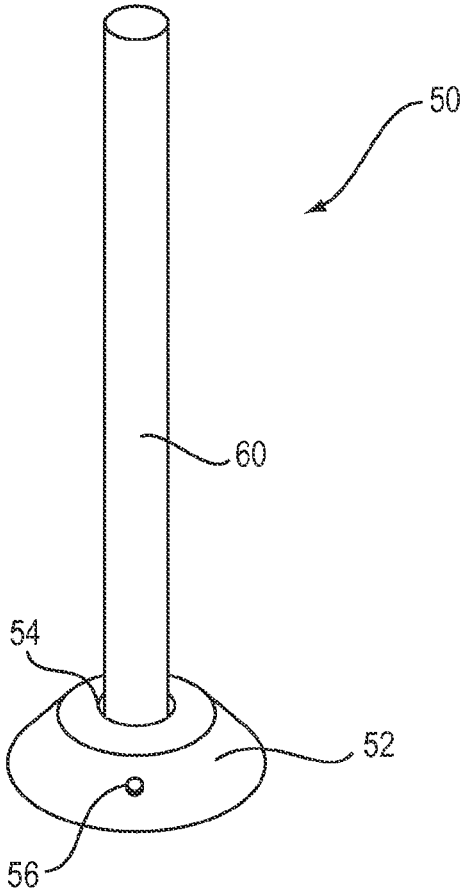
FIG. 10 is a perspective view of another traffic control device.
Figure 11:
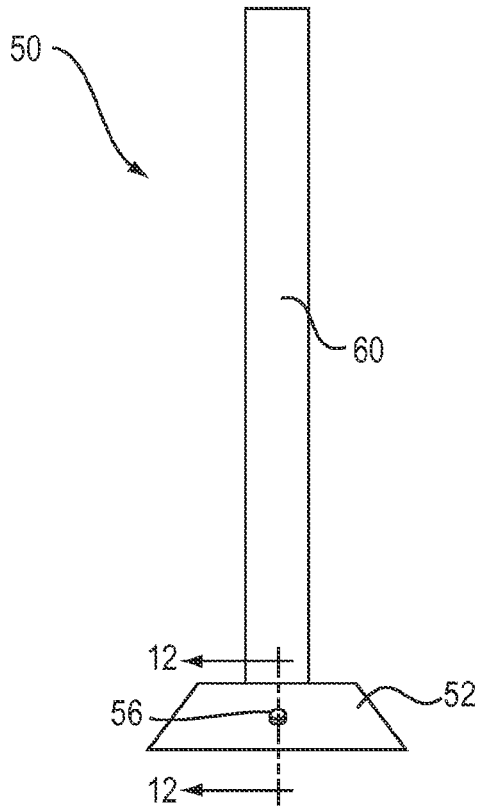
FIG. 11 is a side view of the traffic control device of FIG. 10.

Referring further to the drawings, FIGS. 10 and 11 depict a traffic control device 50 that includes a post 60 removably coupled to a base 52. The base 52 may include a post aperture 54 and a recess 68 for receiving a pavement marker (See FIGS. 12A-12E). The post 60 is removably coupled to the base 52 by inserting the bottom portion of the post 60 into a post aperture 54 in the base 52. The post aperture 54 extends from a top surface of the base 52 to the recess 68 of the base 52. Any convenient and effective attachment mechanism may be used to attach the post 60 to the base 52. For example, the post 60 may be removably attached, such as by friction fitting, where the diameter of the post aperture 54 is only slightly larger that the outside diameter of the bottom portion of the post 60. Alternatively, the post 60 may be attached by locking pins or other effective attachment means. Additionally, the depth at which the post 60 is inserted within the post aperture 54 may vary. For example, and referring to FIG. 12B, the post 60 may be adjustably and removably coupled within the post aperture 54 at a variable distance 69 from the bottom side of the base 52. The variable distance 69 is adjustable in response to how far the post 60 is inserted within the post aperture 54. This allows the post to adjust to various heights in order to accommodate for varying heights of pavement markers 58.

Figure 12A:
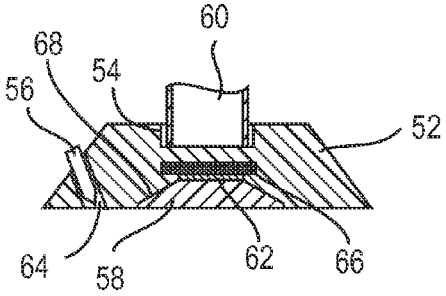
FIGS. 12*a*-12E are section views of a traffic control device taken along line 12-12 of FIG. 11.

Referring to FIG. 12A, the base 52 may include a magnet 66 coupled within the base adjacent the recess 68 of the base 52. The post 60 is adjustably and removably coupled within post aperture 54. The traffic control device 50 further includes a metal plate 62 coupled to a top surface of a pavement marker 58. The base 52 is attached to the metal plate 62 by magnetic attraction between the metal plate 62 and the magnet 66 within the base 52.

Figure 12B:
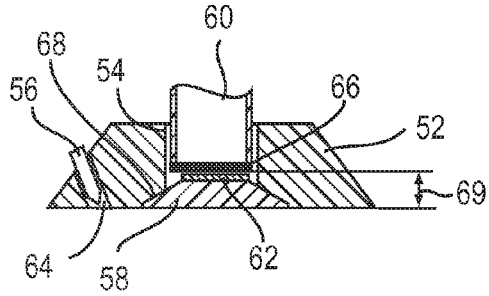

Referring to FIG. 12B, the base 52 may be adjustably and removably coupled to a post 60 within the post aperture 54. The post 60 may have a magnet 66 coupled to an end of the post that is received within the post aperture 54. The traffic control device 50 further includes a metal plate 62 coupled to a top surface of a pavement marker 58. The post 60 is attached to the metal plate 62 by magnetic attraction between the metal plate 62 and the magnet 66 coupled to the post 60. Since the post 60 is adjustable, the traffic control device may be utilized for pavement markers that have various heights to which they extend beyond a surface.

Figure 12C:
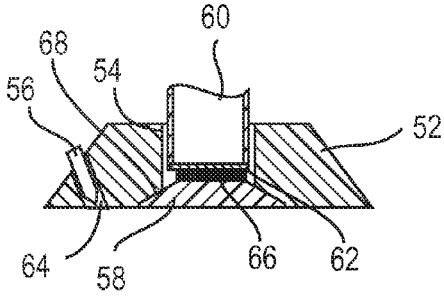

Referring to FIG. 12C, the base 52 may be adjustably and removably coupled to a post 60 within the post aperture 54. The post 60 may have a metal plate 62 coupled to an end of the post that is received within the post aperture 54. The traffic control device 50 further includes a magnet 66 coupled to a top surface of a pavement marker 58. The post 60 is attached to the magnet 66 by magnetic attraction between the magnet 66 and metal plate 62 coupled to the post 60. Since the post 60 is adjustable, the traffic control device may be utilized for pavement markers that have various heights to which they extend beyond a surface.

Figure 12D:
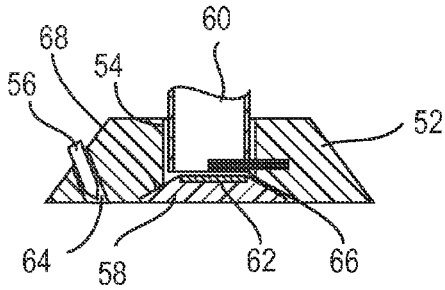

Referring to FIG. 12D, the base 52 may be adjustably and removably coupled to a post 60 within the post aperture 54. The post 60 may have a magnet 66 coupled to an end of the post that is received within the post aperture 54. The traffic control device 50 further includes a metal plate 62 coupled within a pavement marker 58 adjacent a top surface of the pavement marker 58. The post 60 is attached to the metal plate 62 by magnetic attraction between the metal plate 62 and magnet 66 coupled to the post 60. Since the post 60 is adjustable, the traffic control device may be utilized for pavement markers that have various heights to which they extend beyond a surface.

Figure 12E:
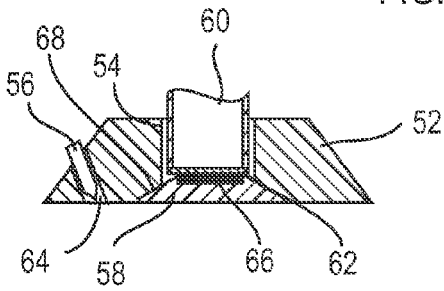

Referring to FIG. 12E, the base 52 may be adjustably and removably coupled to a post 60 within the post aperture 54. The post 60 may have a metal plate 62 coupled to an end of the post that is received within the post aperture 54. The traffic control device 50 further includes a magnet 66 coupled within a pavement marker 58 adjacent a top surface of the pavement marker 58. The post 60 is attached to the magnet 66 by magnetic attraction between the magnet 66 and metal plate 62 coupled to the post 60. Since the post 60 is adjustable, the traffic control device may be utilized for pavement markers that have various heights to which they extend beyond a surface.

In one aspect, the traffic control device 50 may also include a release button 56 for aiding in separating the base 52 or the post 60 from the metal plate 62 or the magnet 66. The release button 56 protrudes from a sidewall of the base 52 and is disposed in button aperture 64 that extends through the base 52. The end portion of the release button 56 that is disposed in the button aperture 64 may have a tapered or pointed end, as shown in FIGS. 12A-12E. Pressing the release button 56 applies pressure to a surface upon which the traffic control device 50 is resting. The pressure applied is sufficient to force separation of the magnet 66 from the metal plate 62, thus weakening the magnetic bond and allowing for easier removal of the traffic control device 50.

Figure 13:
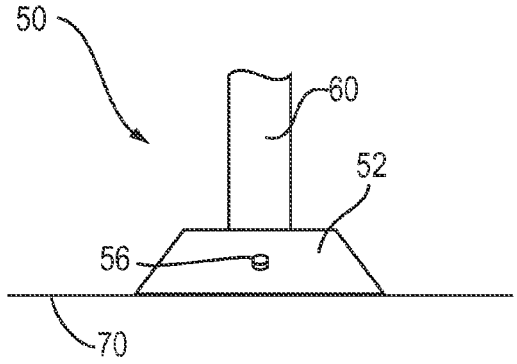
FIG. 13 is an enlarged view of the bottom portion of the traffic control device of FIG. 10 positioned on a surface.

In a method of using the device 50, the pavement marker 58 is fixed to the roadway or surface 70 in a particular location, as shown in FIG. 13. Then, the base 52 and post 60 can be easily affixed to and removed from the surface 70 in the particular location by positioning the base 52 on the pavement marker 58. The pavement marker 58 may be attached to the surface 70 using adhesive, bolts, or any other effective attachment means.

The thickness of the metal plate 62 is sufficient to provide a strong magnetic bond between the plate 62 and the magnet 66, yet is thin enough so that it does not impede the surface. In some embodiments, it may be desirable for the strength of the magnetic bond to be such that the magnet 66 and the metal plate 62 do not need to be in direct contact. For example, a plastic or other protective layer may be disposed over the metal plate 62. The strength of the magnetic bond is sufficient to maintain the traffic control device 50 in a substantially fixed position even though there may be intervening layers between the magnet 66 and the metal plate 62.

Figure 14:
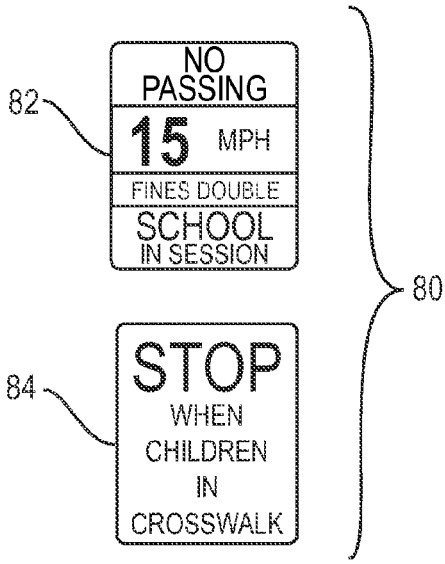
FIG. 14 is a front view of various signs to be used in conjunction with the traffic control device of FIG. 10.

Examples of signs 80 that may be attached to the post 60 are shown in FIG. 14. Signs 82 and 84 are particularly useful in school crossing zones. Alternatively, the post 60 may include a reflective coating or high intensity retro reflective sheeting applied thereto.

Figure 15:
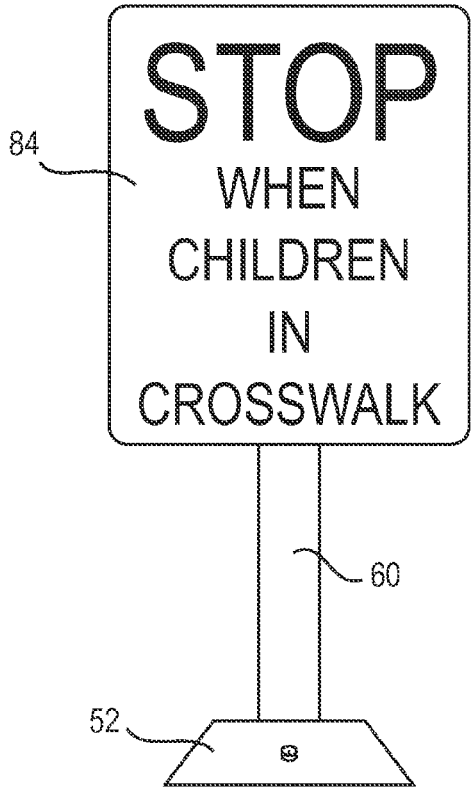
FIG. 15 is a front view of the traffic control device of FIG. 10 with a sign attached.

FIG. 15 shows an example of the traffic control device with a sign 84 attached to the post 60. The sign 84 is used as an example and it should be understood that any other desired sign, including but not limited to those from FIG. 14, may be attached to the post 60. Additionally, attachments to the post 60 are not limited to signs. Any desired symbol, flag or other traffic control measure may be attached to the post 60. The attachment means include adhesive, bolts, straps or any other effective means for attaching signs, symbols, flags, etc to the post 60.

Figure 17A:
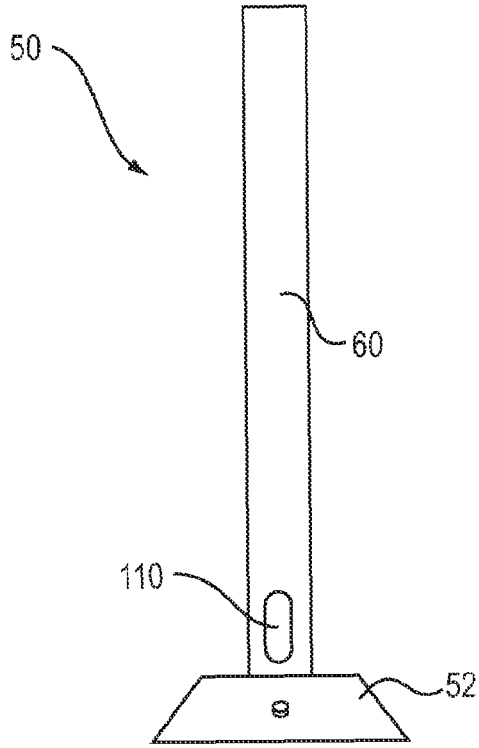
FIG. 17A is a side view of a traffic control device with a cable aperture.
Figure 17B:
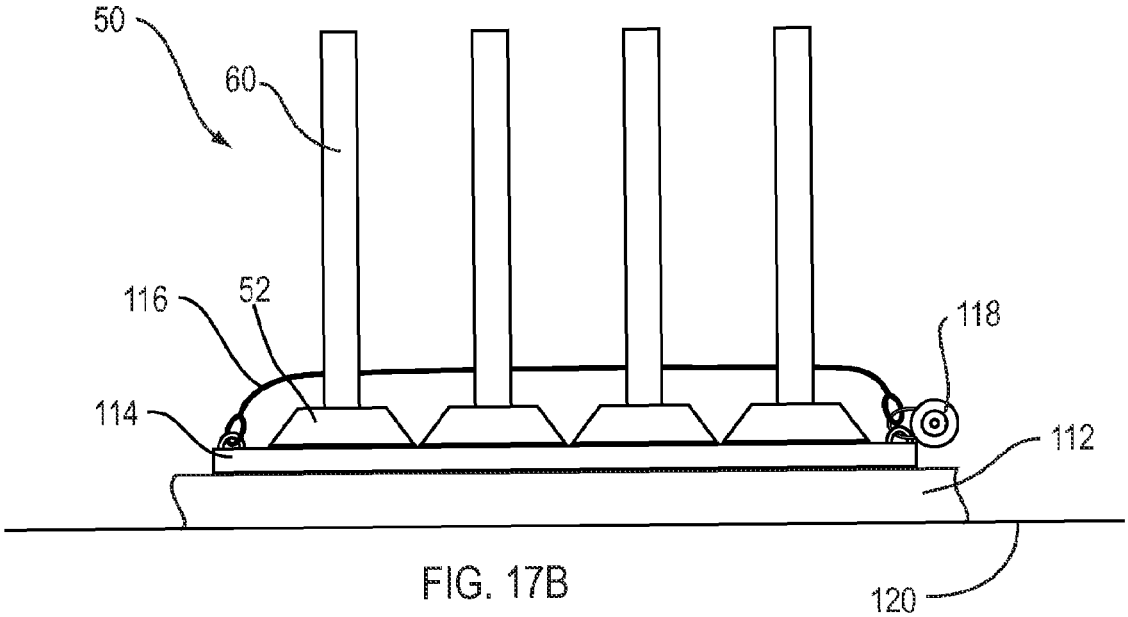
FIG. 17B is a side view of a storage plate with a plurality of traffic control devices.

According to particular embodiments, FIGS. 17A and 17B depict a traffic control device 50 with a cable aperture 110 extending through a post 60 of the traffic control device 50. The traffic control device 50 may also include a storage plate 114 that may be affixed to a sidewalk 112, the sidewalk 112 adjacent a roadway or surface 120. A plurality of traffic control device 50 may be placed on the storage plate 114 by placing the bases 52 of the plurality of control device 50 on the storage plate 114. The storage plate 114 may be formed of metal and provides a magnetic bond between the storage plate 114 and the traffic control devices 50. The storage plate 114 may include a cable 116 coupled on one end to the storage plate 114 or coupled to an anchor device. A loose end of the cable 116 may then be extended through the cable apertures 110 of each of the plurality of traffic control devices 50. The lose end of the cable 116 may then be locked to the storage plate 114 or to another anchor device by use of lock 118. This allows the plurality of traffic control devices 50 to be stored while deterring theft of the traffic control devices 50.

Figure 16:
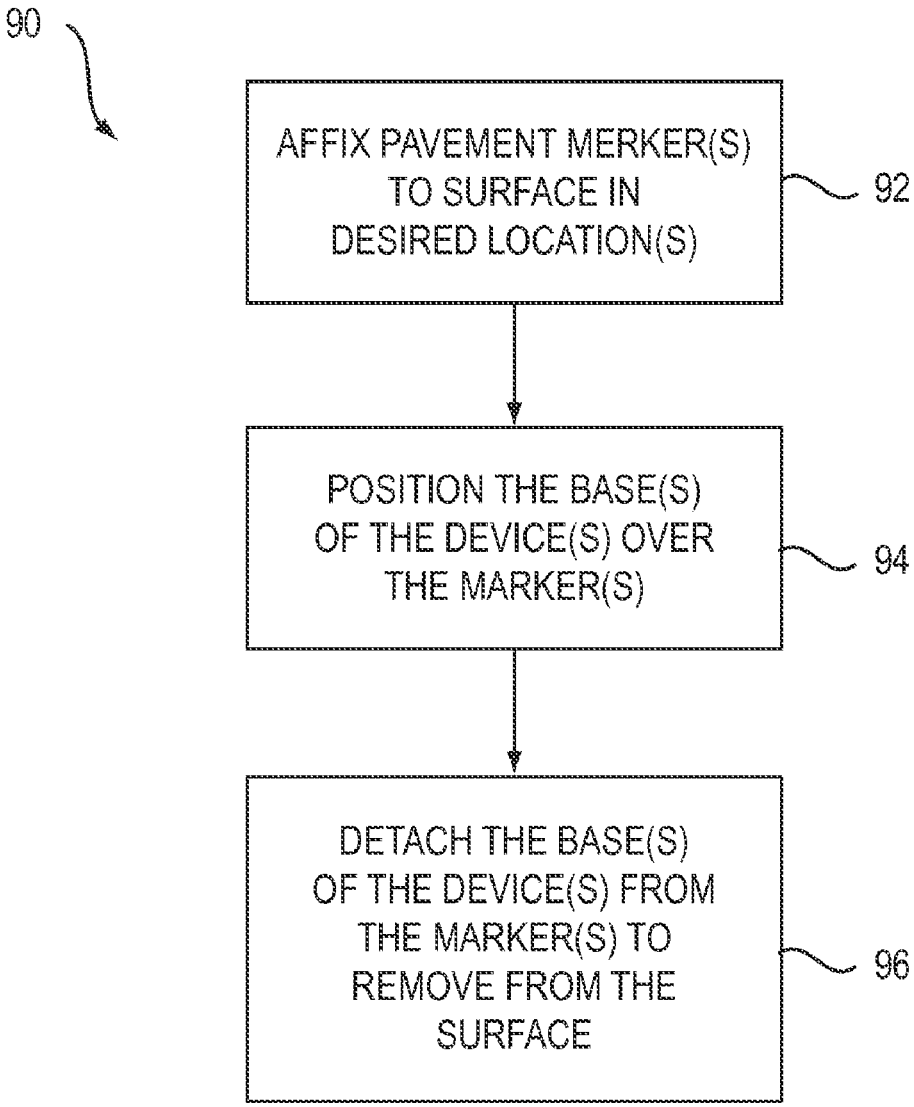
FIG. 16 is a flow chart of the method of using the traffic control device of FIG. 10.

In another aspect, a method 90 of using the device 50 is depicted in FIG. 16. In a first step 92, at least one pavement marker is affixed to the surface in a desired location. In a second step 94, a base with an attached post is positioned over the pavement marker so that the magnet may contact the metal plate. Thus, the base 52 and post 60 are removably coupled to the desired position in the surface. In step 96, when the traffic control device is no longer needed, the base and post are removed from the surface by detaching the base from the plate and re-locating the base to a desired storage location. Detaching the base from the pavement marker may be accomplished by tipping, tilting or lifting the base to break the magnetic bond between the metal plate and the magnet. In another embodiment, detaching the base from the pavement marker may further be accomplished by pressing the release button to break the magnetic bond between the metal plate and the magnet. The method may further include re-locating the traffic control device to a storage location.

The step of re-locating the traffic control device to a storage location may include placing the traffic control device on a storage plate; extending a cable through a cable aperture of the traffic control device; and locking the cable to deter theft of the traffic control device. The pavement markers may be reflective to provide additional awareness to drivers of the crosswalk, particularly after the traffic control device have been detached and re-located.

The traffic control device 50 described above is particularly useful in traffic control situations where it is desirable to repeatably be able to quickly and easily set up and take down several of the devices. In a specific example, in school crossing zones, signs 82 and 84 shown in FIG. 14 may need to be set up and removed at least twice per day during school commute times. Using the traffic control device 50 described above, the set up and removal of the signs and posts is quick and easy and the signs and posts are maintained in a substantially fixed location on the surface. Several posts may be positioned along the edges of a crosswalk in a school crossing zone in alignment with the center line, lane lines and the edge lines of the traffic lane in order to increase driver awareness of the location of the crosswalk, especially in low light or inclement weather conditions. Additionally, signs 82 and 84 may be positioned along the center line at intervals for several feet approaching the crosswalk from each direction to notify a driver of the approaching school crossing zone and reduced speed limit.

It will be understood that the size, shape and materials of the components of the traffic control device may be any effective size, shape or material for performing the function of the component. For example, the material of the metal plate 62, in addition to being magnetically attractive, is preferably corrosion resistant since a corrosion resistant material is better able to withstand the elements and will require less frequent replacement. Although the metal plate 62 is depicted as being circular, it should be understood that the metal plate 62 could also be any other shape.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the invention.

The invention claimed is:

1. A traffic control device comprising:

a base having a post aperture;

a post adjustably and removably coupled to the base through the post aperture;

at least one of a magnet or a metal plate coupled to either of said post or base; and a pavement marker, the pavement marker affixed to a surface, wherein the base includes a recess for receiving the pavement marker, such that a bottom side of the base rests on the surface with the pavement marker retained within the base;

wherein the post is adjustably and removably coupled within the post aperture at a variable distance from a bottom side of the base to accommodate varying heights of pavement markers coupled to a surface.

2. The traffic control device of claim 1, wherein the post aperture extends from a top surface of the base to the recess of the base.

3. The traffic control device of claim 1, wherein the post comprises one of either the magnet or the metal plate coupled to an end of the post.

4. The traffic control device of claim 3, wherein the pavement marker comprises one of either the magnet or the metal plate.

5. The traffic control device of claim 1, further comprising a release button.

6. The traffic control device of claim 5, wherein the release button is disposed in a through hole in a sidewall of the base.

7. The traffic control device of claim 6, wherein the release button protrudes from an outside wall of the base.

8. The traffic control device of claim 7, wherein the release button includes a tapered end.

9. The traffic control device of claim 1, wherein the variable distance is adjusted in response to how far the post is inserted within the post aperture.

10. The traffic control device of claim 4, wherein the pavement marker comprises the magnet and the post comprises the metal plate.

11. The traffic control device of claim 4, wherein the pavement marker comprises the metal plate and the post comprises the magnet.

* * * * *